US010596075B2

(12) United States Patent
Uitbeijerse

(10) Patent No.: US 10,596,075 B2
(45) Date of Patent: Mar. 24, 2020

(54) PACIFIER WITH CONTROLLABLE HARDNESS OF THE NIPPLE PORTION

(71) Applicant: KONINKLIJKE PHILIPS N.V., Eindhoven (NL)

(72) Inventor: Bastiaan Uitbeijerse, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 157 days.

(21) Appl. No.: 15/575,853

(22) PCT Filed: May 18, 2016

(86) PCT No.: PCT/EP2016/061054
§ 371 (c)(1),
(2) Date: Nov. 21, 2017

(87) PCT Pub. No.: WO2016/192985
PCT Pub. Date: Dec. 8, 2016

(65) Prior Publication Data

US 2018/0116913 A1 May 3, 2018

(30) Foreign Application Priority Data

Jun. 3, 2015 (EP) ..... 15170547

(51) Int. Cl.
*A61J 17/00* (2006.01)
*A61J 11/00* (2006.01)

(52) U.S. Cl.
CPC ..... *A61J 17/001* (2015.05); *A61J 11/0035* (2013.01); *A61J 17/008* (2015.05)

(58) Field of Classification Search
CPC ..... A61B 17/221; A61J 17/001
See application file for complete search history.

(56) References Cited

U.S. PATENT DOCUMENTS

| | | | | |
|---|---|---|---|---|
| 3,022,915 | A | 2/1962 | Mullin | |
| 4,898,171 | A | 2/1990 | Moss | |
| 5,658,314 | A | 8/1997 | Scheffer | |
| 6,033,367 | A | 3/2000 | Goldfield | |
| 7,731,733 | B2 | 6/2010 | Tesini | |
| 8,049,920 | B2 | 11/2011 | Yamaguchi | |
| 8,545,230 | B2 | 10/2013 | Stalling | |
| 2006/0079814 | A1* | 4/2006 | Barlow | A61B 5/038 600/590 |

(Continued)

FOREIGN PATENT DOCUMENTS

| | | | |
|---|---|---|---|
| JP | 2003284762 | A | 10/2003 |
| WO | 2010033252 | A1 | 3/2010 |
| WO | 2010046812 | A1 | 4/2010 |

*Primary Examiner* — Richard G Louis

(57) ABSTRACT

The present invention relates to pacifiers (10), which can support a child in its oral development, from sucking to mature drinking and eating reflex or which helps in the process of teething. A pacifier (10) is provided, which comprises a shield (12), a cherry or nipple portion (14) with controllable hardness and a controller for controlling the hardness of the cherry or the nipple portion. By increasing the hardness of the nipple portion, the child is de-motivated to suck on a pacifier (10) and the child will lose the need for suckling. However, there are moments when the child does need to be nourished and comforted by engaging the sucking reflex. In this case the cherry can be made softer.

20 Claims, 3 Drawing Sheets

(56) References Cited

U.S. PATENT DOCUMENTS

| | | | | |
|---|---|---|---|---|
| 2006/0104914 | A1* | 5/2006 | Soroudi | A61F 7/03 424/45 |
| 2008/0033489 | A1* | 2/2008 | Tesini | A61J 17/001 606/235 |
| 2008/0077183 | A1* | 3/2008 | Cohen | A61B 5/038 606/234 |
| 2010/0069723 | A1* | 3/2010 | Islam | H01S 3/302 600/300 |

* cited by examiner

PACIFIER WITH CONTROLLABLE HARDNESS OF THE NIPPLE PORTION

This application is the U.S. National Phase application under 35 U.S.C. § 371 of International Application No. PCT/EP2016/061054, filed on May 18, 2016, which claims the benefit of International Application No. 15170547.2 filed on Jun. 3, 2015. These applications are hereby incorporated by reference herein.

FIELD OF THE INVENTION

The present invention relates to a pacifier, in particular for supporting a de-soothing procedure of children and/or for teething.

BACKGROUND OF THE INVENTION

Pacifiers, also called soothers, are known for a long time and are widely used to calm down children. However, an extensive and too long use of pacifiers may lead to problems during and after the development of the teeth of the child and can cause severe disturbances during the jaw development of the child. Children are born with the reflex to suck, which makes them able to be breast fed by the mother immediately after birth without learning. During the development from infant to toddler the child needs to develop its oral sucking reflex into a normal eating and drinking reflex. Therefore, it is desired to wean the children from the pacifier, the so-called de-soothing.

To support a de-soothing it is for example known from U.S. Pat. No. 7,731,733 B2 to provide a pacifier, which will expand or move upward and outward as the child sucks on it. Further, WO 2010/033252 A1 discloses a method and appartus for a non-nutritive suck entrainment pulse generator. An embodiment includes a valve assembly in communication with a first pressure and a second pressure to change a pressure of a baglet. A controller can switch the valve assembly to selectively couple the first and second pressures to the baglet to produce a series of pressure pulses within the baglet.

SUMMARY OF THE INVENTION

It is an object of the present invention to provide a pacifier, which further improves the de-soothing of children and/or which helps the child in the process of teething.

In an aspect of the present invention a pacifier is presented comprising a shield, a nipple portion having a controllable hardness, and a controller for controlling the hardness of the nipple portion. By increasing the hardness of the nipple portion of the pacifier, it gets less comfortable for the child to suck on the nipple portion, thus the need for suckling is reduced and the child gets continuously de-soothed. Further, in the process of teething a child often wants to bite on things. Hence, it may help the child to gradually change the hardness of the nipple portion during this process.

It is of advantage, that different degrees of hardness of the nipple portion can be realized by one single pacifier, thus for the entire de-soothing or teething procedure only one pacifier can be used. Consequently, it is not necessary to have a set of pacifiers on stock with different cherry hardness degrees, or to change the cherry of the pacifier with a cherry of a different degree of hardness. Further, by using the same pacifier, the child does not connect the reduced comfort in suckling with a change of the pacifier. Thus, the child will not ask for a more comfortable pacifier, but stick to the pacifier it is used to, which further supports the de-soothing process. Another advantage is that the hardness of the nipple portion can be reduced, if the child needs to be calmed down or if the hardness of the nipple portion was changed too fast. There are moments in which the child does need to be nourished and comforted by engaging the sucking reflex.

In a further embodiment the controller is configured for controlling the hardness continuously variable. In this way, the hardness of the nipple portion can be increased very slowly, so that the child does not recognize the reduced comfort immediately. Thus, the child can be de-soothed in very small steps without identifying the reduced comfort with a change of the hardness of the nipple portion.

In a preferred embodiment the nipple portion comprises compressible material and the controller comprises a compressor for compressing or decompressing the compressible material. By this, the adjustable hardness of the nipple portion can be realized very cost and production effective.

In a further preferred embodiment the nipple portion comprises a chamber in which the compressible material is arranged. Thus, the nipple portion can be filled with a material that comprises better characteristics in changing the hardness of the nipple portion when being compressed or decompressed. Furthermore, known materials can be used for the nipple portion, thus no additional tests need to be performed if the outer material is suitable for the nipple portion of a pacifier.

It shall be noted that it is not mandatory that a compressible and decompressible material is used. Other materials may be used which can not be compressed and decompressed, which may generally be considered as a kind of "transfer material" that can transfer a force to change the hardness of the nipple portion.

In a further embodiment the compressible material comprises a gas, a liquid or a solid material or any combination thereof. In this way, the specific material can be selected with respect to the desired degrees of hardness. For example, when using a solid material a high degree of hardness can be achieved very easily. Further, when using a gas the hardness changes slowly and can therefore be adjusted very precisely. When using a liquid, a large range of degrees of hardness can be covered. With solid materials less complex shapes are feasible than with liquid and gaseous material. A phase change of material could make best of both possibilities. For instance, by use of electroactive materials or sodium acetate this principle could be implemented. Sodium acetate generates an exothermic reaction, which may also increase the comfort of the soother when it warms up, because a cold soother is not nice for a baby. It should also be noted that the shape of the cherry does change slightly when the hardness is changed. Due to pressure and stress not only the hardness but also the size increases.

In a further embodiment the compressor comprises a bolt, which is movable within the nipple portion for compressing or decompressing the compressible material depending on the position of the bolt, wherein the controller comprises an actuator for actuating the bolt. By this design compressing or decompressing is achieved in a simple and therefore cost and production effective manner. Further, the compressor can be easily integrated into the pacifier, since the bolt can be integrated into the nipple portion.

In a further embodiment the controller comprises a turning nob and a screw thread or a wedge for actuating the bolt. The controller can thus be integrated very easily in the shield and nipple portion of the pacifier. It is also possible to entirely remove the turning knob and bolt and thus add or remove material from or to the nipple portion. Thus, a large range of degrees of hardness of the nipple portion can be realized. It is also possible to extend or shorten the bolt in order to extend the range of degrees of hardness. Hereby, a screw thread may in principle be considered as a circular wedge.

In a further preferred embodiment the controller comprises a lever for actuating the bolt. By this, the comfort in adjusting the hardness of the nipple portion can be increased, since a smaller force has to be applied depending on the lever used.

In a further embodiment the controller comprises a bolt, which is movable within the nipple portion, wherein the nipple portion comprises a solid material, which can be displaced by the bolt. This embodiment is advantageous since the entire nipple portion can be produced in one piece and therefore the nipple portion can be produced easily and fast. Further, the manufacturing tolerances for this embodiment can be chosen less strict, since the pacifier does not need to be sealed in order to change the hardness of the nipple portion. In case of a broken nipple portion the child is not disturbed or harmed since no material from the inner side of the nipple portion will be released into the child's mouth.

In a further embodiment the compressible material comprises a gas, and the device to compress or decompress the compressible material comprises a pump and a valve, wherein the pump and the valve are arranged airtight with the inner portion of the nipple portion and the compressible material is compressed or decompressed by pumping air into the nipple portion with the pump or releasing air from the nipple portion by the valve. By this design it is possible to cover a huge range of degrees of hardness of the nipple portion. Further, in case of a broken/leak nipple portion the child is not harmed since only air will be released into the child's mouth.

In a further embodiment the nipple portion comprises electroactive polymers and the pacifier comprises a voltage supply, wherein the controller is configured to apply a voltage to the electroactive polymers to control the hardness of the nipple portion. By this, the hardness of the nipple portion can be controlled very comfortably, since no force is needed to apply stress or pressure to the material in order to increase the hardness of the nipple portion.

In a further embodiment the controller comprises a receiving unit for receiving a control signal and a processor for processing the control signal and controlling the hardness of the nipple portion according to the control signal. This is advantageous since by using a control signal the hardness of the nipple portion can be adjusted very precisely.

It is also possible to create a data profile and adjust the hardness of the nipple portion depending on the daytime. The comfort for suckling can be reduced to a larger extent during daytime, but increased during the time period when the child goes to sleep. Thus, the child gets de-soothed during day time but can be put to sleep with are more comfortable pacifier, so that the child will sleep faster and does thereby not loose sleep because of de-soothing.

In a further embodiment the receiving unit is adapted to receive the control signal wirelessly and the pacifier comprises a power supply to be operated independently. The hardness of nipple portion can thus be controlled wirelessly. The pacifier does not need to be taken away from the child in order to adjust the hardness of the nipple portion, which increases the comfort in handling the pacifier.

In situations when the child is sleeping and monitored by a baby phone or a similar device, the parents can react, if they notice via the baby phone that the child starts to get noisy or unruly and adjust the hardness of the nipple portion remotely without disturbing or waking up the child.

The present invention is generally used for reducing a child's (in particular a baby's) need for suckling. However, the proposed approach can also be used for other purposes and, generally, for other persons than babies and children, for instance for teething. Children do get teeth and do like to bite as well besides using a soother. When a cherry can be made harder or more solid, it could be used for teething. Also a shape change or macro structure change can be used to enable this teething, such as a wider or thicker base of the cherry and/or ribs, grooves and nobs enable teething.

BRIEF DESCRIPTION OF THE DRAWINGS

These and other aspects of the invention will be apparent from and elucidated with reference to the embodiments described hereinafter. In the following drawings

DETAILED DESCRIPTION OF THE EMBODIMENTS

Figure 1A:
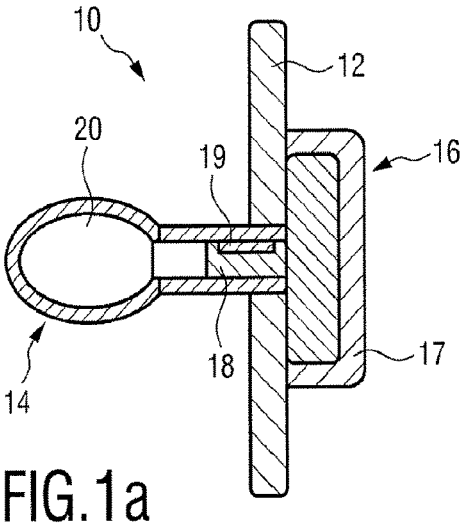
FIG. 1 shows a first embodiment of a pacifier according to the present invention.
Figure 1B:
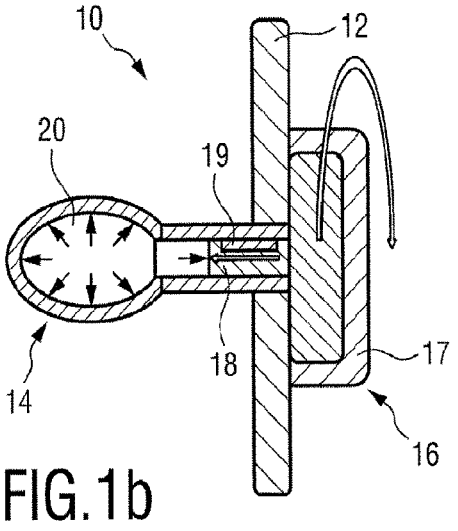

FIG. 1*a* shows a pacifier according to the present invention. The pacifier comprising a nipple portion 14 formed of an elastomer, a shield 12 formed of plastic, wood, an elastomer or any other suitable material and a controller 16 for controlling the hardness of the nipple portion 14. The controller 16 comprises a turning knob 17 and a screw thread 19 for actuating a bolt 18. The nipple portion 14 comprises a solid material, a gas or a liquid which can preferably be compressed or decompressed (or which can be used to transfer a force) by an axial movement of the bolt 18 in the nipple portion 14. When the turning knob 17 is turned the bolt 18 is actuated in an axial direction in the nipple portion 14 by the screw thread 19, as indicated in FIG. 1*b*. Thus, said solid material, gas or liquid is compressed or decompressed and the hardness of the nipple portion 14 of the pacifier 10 is changed, as indicated by the arrows of FIG. 1*b*. By compressing or decompressing the solid material, a gas or a liquid a certain stress is applied to the elastomer of the nipple portion 14 and thus the hardness of the elastomer changes, which reduces or increases the suckling comfort.

Figure 2A:
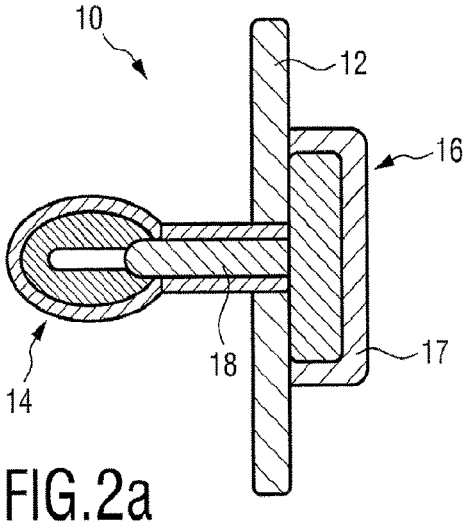
FIG. 2 shows a second embodiment of a pacifier according to the present invention.
Figure 2B:
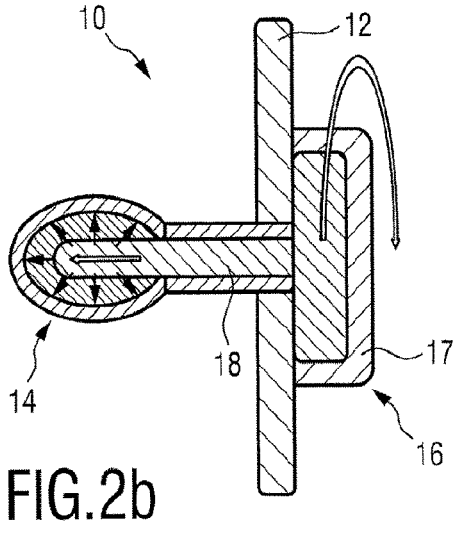

FIG. 2*a* shows a pacifier 10 according to the present invention, wherein the nipple portion 14 comprises a solid material and wherein the bolt 18 is adapted to displace the solid material in order to increase the hardness of the nipple portion 14 as indicated by the arrows in FIG. 2*b*. The bolt 18 may be actuated in the same manner as described above. The bolt 18 may also be pushed into the nipple portion 14 by applying a force to the bolt 18, or the nipple portion 14 may comprise a snap-in locking device to retain the bolt 18. When the bolt 18 is inserted in the nipple portion 14, the solid material is displaced. This displacement causes stress to the nipple portion 14 and thereby increases the hardness of the nipple portion 14. The stress is relieved and the hardness of the nipple portion 14 is decreased when the bolt 18 is removed from the nipple portion 14.

Figure 3A:
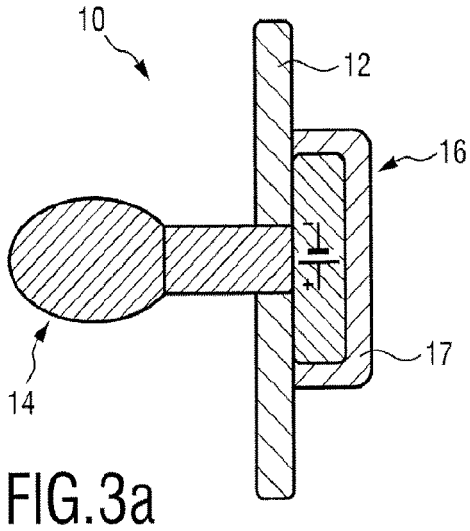
FIG. 3 shows a third embodiment of a pacifier according to the present invention.
Figure 3B:
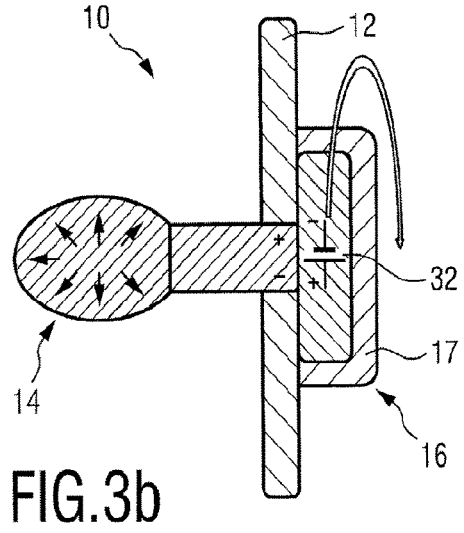

In FIG. 3*a* another embodiment according to the present invention is shown, wherein the nipple portion 14 comprises an electroactive polymer and wherein the controller 16 comprises a voltage supply 32 and wherein the controller 16 is adapted to apply a voltage to the nipple portion 14. Said controller 16 comprises for example a potentiometer included in the shield 12 of the pacifier 10. Thus, the voltage supplied by the voltage supply 32 can be divided by the potentiometer. A part of said divided voltage is applied to the polymer in the nipple portion 14, which causes the polymer to put stress on the elastomer of the nipple portion 14. The hardness of the nipple portion 14 is controlled by the transferred stress. Thus, the hardness of the nipple portion 14 is decreased or increased according to the voltage applied to the electroactive polymer, as indicated by the arrows in FIG. 3*b*. The controller 16 might also comprise two buttons, one to increase and one to decrease the hardness and a circuit to increase or decrease the voltage according to the input via said buttons.

In yet another embodiment, the controller 16 may comprise two buttons and a circuit, which applies predetermined voltages to the polymer. In this embodiment, a sort of de-soothering timetable can be achieved, wherein the hardness of the nipple portion 14 is increased in predetermined recommended steps.

Figure 4A:
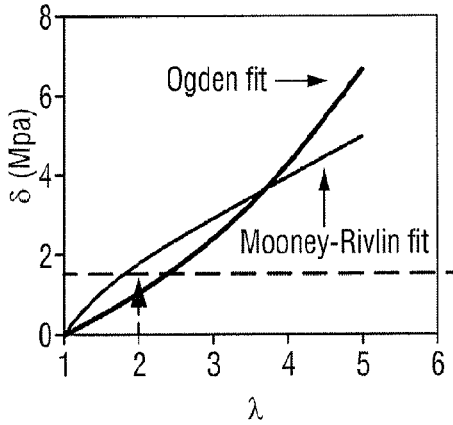
FIG. 4*a* shows a diagram illustrating the stress that will occur when a displacement $\lambda$ is applied in an elastomer.

In FIG. 4*a* a diagram is shown, which shows the amplitude of stress that will occur when a certain displacement ($\lambda$) is applied in an elastomer. It can be seen that this dependency comprises a smooth monotonic behavior.

Figure 4B:
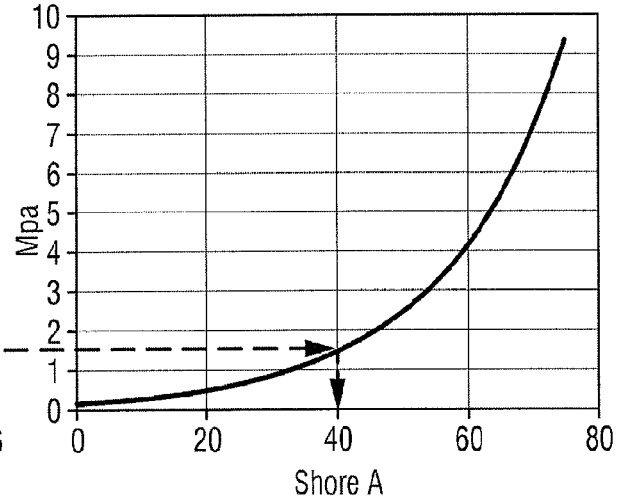
FIG. 4*b* shows a diagram illustrating how the hardness of an elastomer changes in dependence on the applied stress.

FIG. 4*b* shows a diagram that shows how the hardness of the elastomer will change with the amount of stress that is applied to said elastomer. The arrows in FIGS. 4*a* and 4*b* indicate a matching point. It can be seen, that by a displacement of 1 arbitrary unit a stress of approximately 2 MPa, which corresponds to a shore hardness of 40 arbitrary units, is achieved. In this context, it should be noted that shore durometer is a method to describe hardness of elastomer materials, which is equivalent of the $N/mm^2$. When a material is stretched/displaced in mm or % it becomes harder.

Further, it can be seen that both dependencies change monotonic, thus the hardness of the nipple portion 14 can be adjusted very precisely by applying a displacement in said elastomer. There are different fits to describe elastomer material behavior. Mostly, Mooney-Rivlin is used for the LSR (Liquid Silicon Rubber) that is preferably used for the cherries of soothers. This graph is a generic example and shows generic behavior; between different LSRs there are differences. LSR is a thermoharder elastomer. When molded it is liquid, it cures and becomes solid due to heat. This process cannot be reversed. It may be used for the cherry of the proposed pacifier, because it has good quality. Alternatively, thermoplastic elastomers (TPE) may be used for the cherry. In general all elastomers can be used.

Figure 5:
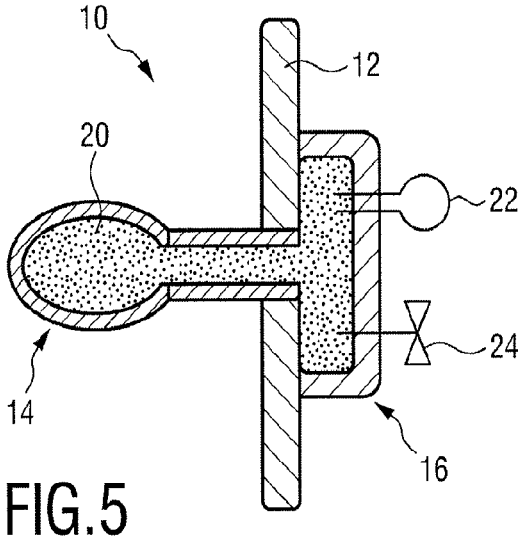
FIG. 5 shows a fourth embodiment of a pacifier according the present invention comprising a pump and a valve.

In FIG. 5 a pacifier 10 according to the present invention is shown, which comprises a nipple portion 14, which is arranged airtight with the controller 16, wherein the controller 16 comprises a pump 22 and a valve 24. In this embodiment the pump 22 can be used to pump 22 air into the nipple portion 14 and by this increase the stress applied to the nipple portion 14 and thus, increase the hardness of the nipple portion 14. The valve 24 can be used to release air from the nipple portion 14 in order to reduce stress applied to the nipple portion 14 and thus, decrease the hardness of the nipple portion 14. This embodiment is very advantageous since a wide range of degrees of hardness of the nipple portion 14 can be covered. Since air is available no storage of air is needed and a lot of air can be pumped into the chamber 20 of the nipple portion 14 to achieve a high degree of hardness and almost all air can be removed from the chamber 20 of the nipple portion 14 to achieve a very low degree of hardness.

Figure 6:
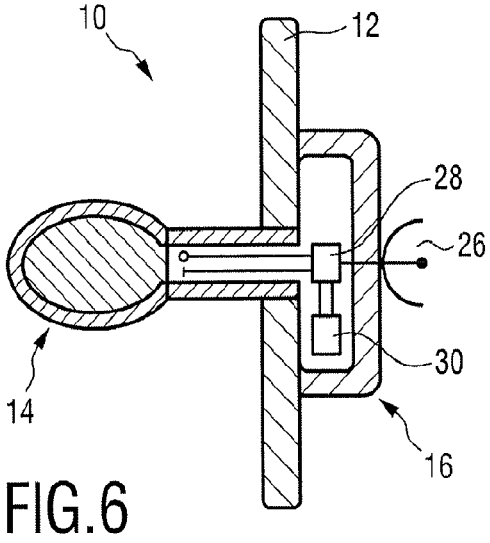
FIG. 6 shows a fifth embodiment of a pacifier according to the present invention.

FIG. 6 shows an embodiment of the present invention, wherein the pacifier 10 comprises electroactive polymer in the nipple portion, a receiving unit 26 for receiving wirelessly a control signal, a processor 28 for processing the received control signal, a power supply 30 and a controller 16 for applying a voltage to the electroactive polymer in accordance with the control signal, in order to adjust the hardness of the nipple portion. In this preferred embodiment the hardness of the nipple portion 14 can be controlled by a wireless device, for example by a smartphone or a remote control. Thus, the hardness of the nipple portion 14 can be adjusted without taking the pacifier 10 away from the child. It is also possible to adjust the hardness of the nipple portion 14 without being in the same room as the child. Thus, the parents can increase or decrease the hardness of the nipple portion 14 while surveying the child via a baby phone or any similar device. This leads to a very comfortable handling situation, especially when the child is sleeping or just about to fall asleep. Since a parent might just decrease the hardness of the nipple portion 14 to calm the child down to finally fall asleep even without opening the door and disturbing the child.

Figure 7:
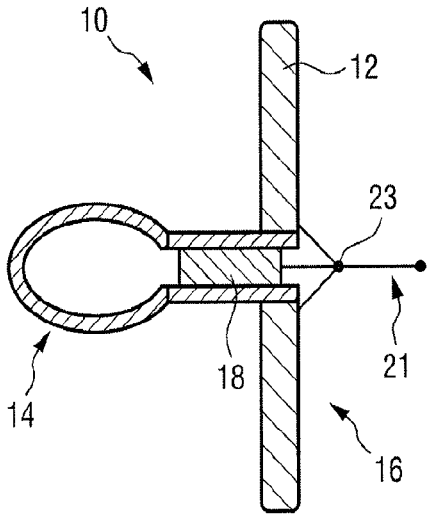
FIG. 7 shows a sixth embodiment of a pacifier according to the present invention.

FIG. 7 shows an embodiment of the present invention, wherein the actuator comprises a lever 21 which is arranged at a joint 23 and connected with the bolt 18. By actuating the lever 21 the bolt 18 is moved within the nipple portion and compresses or decompresses the compressible material. By this the hardness of the nipple portion 14 is controlled. In this embodiment the hardness of the nipple portion can be changed with less force, depending on the applied lever 18.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

It is understood, that the present invention, although shown exemplarily for a soother or pacifier, is not limited to this disclosed embodiment. By those skilled in the art it is without creative efforts possible to transfer the disclosed subject-matter to teats, spouts and straws of drinking and feeding devices for babies, toddlers and children of any age.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A pacifier comprising:

a shield;

a nipple portion having a controllable hardness; and a controller for controlling the hardness of the nipple portion;

wherein the controller comprises a receiving unit for receiving a control signal and a processor for processing the control signal and controlling the hardness of the nipple portion according to the control signal, wherein the nipple portion comprises compressible material and wherein the controller comprises a compressor for compressing or decompressing the compressible material, and wherein the compressor comprises a bolt, wherein the bolt is movable within the nipple portion and within the compressible material for compressing or decompressing the compressible material depending on the position of the bolt within the compressible material, wherein the controller comprises an actuator for actuating the bolt within the nipple portion and within the compressible material for compressing or decompressing the compressible material.

2. The pacifier of claim 1, wherein the controller is configured for controlling the hardness continuously variable.

3. The pacifier of claim 1, wherein the nipple portion comprises a chamber in which the compressible material is arranged.

4. The pacifier of claim 3, wherein the compressible material comprises a gas, a liquid or a solid material or any combination thereof.

5. The pacifier of claim 1, wherein the actuator comprises a turning knob and a screw thread or wedge for actuating the bolt.

6. The pacifier of claim 1, wherein the actuator comprises a lever for actuating the bolt.

7. The pacifier of claim 1, wherein the compressible material comprises a compressible solid material disposed within a chamber of the nipple portion, wherein the compressible solid material is displaced by the bolt for compressing and decompressing the compressible solid material.

8. The pacifier of claim 1, wherein the compressible material includes a gas, wherein the controller is further configured to compress or decompress the gas via a pump and a valve, wherein the pump and the valve are arranged air tight with an inner portion of the nipple portion, wherein the gas is compressed or decompressed by pumping air into the nipple portion with the pump or releasing air from the nipple portion by the valve.

9. The pacifier of claim 1, wherein the receiving unit is adapted to receive the control signal wirelessly and wherein the pacifier comprises a power supply to be operated independently.

10. The pacifier of claim 1, wherein the nipple portion comprises sodium acetate.

11. The pacifier of claim 1, wherein the nipple portion is configured to change its shape and/or structure, in particular to change the size of its base and/or to form ribs, grooves and/or nobs on its surface.

12. A pacifier comprising:

a shield;

a nipple portion having a controllable hardness; and a controller for controlling the hardness of the nipple portion, wherein the controller comprises a receiving unit for receiving a control signal and a processor for processing the control signal and controlling the hardness of the nipple portion according to the control signal, and wherein the nipple portion comprises electroactive polymers and the pacifier comprises a voltage supply, wherein the controller is configured to apply a voltage to the electroactive polymers to control the hardness to the nipple portion.

13. The pacifier of claim 12, wherein the controller is configured for controlling the hardness continuously variable.

14. The pacifier of claim 12, wherein the nipple portion further comprises a chamber in which compressible material is arranged.

15. The pacifier of claim 14, wherein the compressible material comprises a gas, a liquid or a solid material or any combination thereof.

16. The pacifier of claim 12, wherein the receiving unit is adapted to receive the control signal wirelessly.

17. The pacifier of claim 12, wherein the nipple portion is configured for at least one selected from the group consisting of (i) to change its shape, (ii) to change its structure, (iii) to change a size of its base, and (iv) to form ribs, grooves and/or nobs on its surface.

18. The pacifier of claim 12, wherein the receiving unit is further for receiving a data profile for adjusting the hardness of the nipple portion depending on the data profile.

19. The pacifier of claim 12, further comprising a potentiometer, wherein the voltage supplied by the voltage supply is divided by the potentiometer.

20. The pacifier of claim 12, further comprising at least one button configured to increase or decrease the hardness, wherein the controller increases or decreases the voltage according to an input via the at least one button.

* * * * *